United States Patent [19]

Comolli

[11] Patent Number: 4,685,315

[45] Date of Patent: Aug. 11, 1987

[54] STRAP LOCK FOR SUITCASES, BAGS, OR THE LIKE

[76] Inventor: Severino Comolli, Via M. Pagano 69/A, Milan, Italy

[21] Appl. No.: 755,258

[22] Filed: Jul. 15, 1985

[51] Int. Cl.[4] ..... E05B 67/38; E05B 73/00; A44B 11/00; A44B 11/12

[52] U.S. Cl. ..... 70/68; 70/18; 24/167; 24/170; 24/193

[58] Field of Search ..... 70/68, 18, 14, 15, 30, 70/49, 57, 58, 64, 67, 69; 24/167, 166, 170, 191, 193

[56] References Cited

U.S. PATENT DOCUMENTS

| | | | |
|---|---|---|---|
| 338,327 | 3/1986 | Winter | 24/193 |
| 555,829 | 3/1896 | Rogers | 24/167 |
| 590,613 | 9/1897 | Garrett | 24/167 |
| 624,559 | 5/1899 | Spaulding | 24/167 |
| 700,158 | 5/1902 | Stoneman | 24/167 |
| 735,689 | 8/1903 | Adams | 24/167 |
| 759,305 | 5/1904 | Nunn | 24/167 |
| 872,865 | 12/1907 | Verch | 24/167 |
| 1,398,638 | 11/1921 | Graham | 24/167 |
| 2,287,722 | 6/1942 | Beazley | 24/170 |
| 2,442,266 | 5/1948 | Davis | 24/193 |
| 2,598,369 | 5/1952 | Grandi | 24/170 |
| 2,903,774 | 9/1959 | Harley | 24/170 |
| 3,131,985 | 5/1964 | Blonder | 70/57 |
| 3,592,028 | 7/1971 | Monica | 70/57 |
| 3,696,471 | 10/1972 | Mermelstein | 24/193 |
| 3,875,771 | 4/1975 | Reisner | 70/18 |
| 4,051,743 | 10/1977 | Gaylord | 24/193 |
| 4,233,713 | 11/1980 | Berg | 24/170 |

FOREIGN PATENT DOCUMENTS

| | | | |
|---|---|---|---|
| 2725843 | 12/1977 | Fed. Rep. of Germany | 70/18 |
| 1230960 | 9/1960 | France | 24/193 |
| 467949 | 12/1951 | Italy | 70/57 |
| 687434 | 3/1965 | Italy | 24/193 |
| 27596 | 2/1903 | Switzerland | 24/167 |
| 15851 | of 1908 | United Kingdom | 24/167 |
| 2088461 | 6/1982 | United Kingdom | 24/193 |
| 2122296 | 1/1984 | United Kingdom | 24/193 |

*Primary Examiner*—Gary L. Smith
*Assistant Examiner*—Vinh Luong
*Attorney, Agent, or Firm*—Guido Modiano; Albert Josif

[57] ABSTRACT

A strap lock for suitcases, bags or the like, comprises a box-type body associable with a first end of a strap and having a slit for inserting the second end of the strap therethrough. The box-type body is adapted to be closed by a lid associated therewith. The device further comprises an eccentric shaft cooperating with the inner surface of the box-type body to releasably lock the second strap end securely and being actuated on closing the lid. A lock is provided for the safety closure between the box-type body and the lid.

2 Claims, 8 Drawing Figures

STRAP LOCK FOR SUITCASES, BAGS, OR THE LIKE

BACKGROUND OF THE INVENTION

This invention relates to a strap lock for the safety closure of, in particular, suitcases, bags, or the like.

Devices for the safety closure of bags, suitcases or the like are known and generally comprise a box-type body associated with one end of a strap, carried on the suitcase itself or independent, which hooks on the other end by means of lockable means with strap lock of various description.

In some of these devices hooking takes place through the insertion of serrations, driven by the key rotation, into specially provided holes in the strap, as in U.S. patent application Ser. No. 310,677 filed on Oct. 13, 1981 now abandoned by this same Applicant.

With other device types, hooking is accomplished by closing the lid carried on the box-type body which has prongs penetrating the end of the strap to be withheld.

There also exist padlock, chain systems, etc.

Such devices are not devoid of drawbacks, however, and in fact, where holes are to be made in the strap, stiffening of the hole edges is required to compensate for the decreased strength and not to create areas which might trigger a tear in the event of a violent pull on the strap itself.

With imperforated straps, penetrated by prongs, it is apparent that a prolonged use of devices of this kind results inevitably in wearing and consequent breakage of the strap.

With other systems, such as padlocks or chains, poor practicality and rapidity is experienced in closing and opening the device.

SUMMARY OF THE INVENTION

It is a primary object of this invention to provide a strap lock having good safety and practicality features.

Another object of the invention is to provide a strap lock which allows the strap to be locked in a simple and reliable manner and can limit its wear.

These and other objects are achieved by a strap lock for suitcases, bags or the like, comprising a box-type body associable with a first end of a strap and having a slit for inserting the second end of the strap therethrough, said box-type body being adapted to be shut by means of a lid associated therewith, characterised in that it comprises an eccentric means cooperating with the inner surface of said box-type body to releasably lock said second strap end securely and being actuated on closing said lid, a lock being provided for the safety closure between said box-type body and said lid.

BRIEF DESCRIPTION OF THE DRAWINGS

Further features and advantages will be apparent from the following detailed description of a strap lock according to the invention, as shown by way of illustration in the accompanying drawing, where.

DESCRIPTION OF THE PREFERRED EMBODIMENTS

Figures 1, 2, 3:
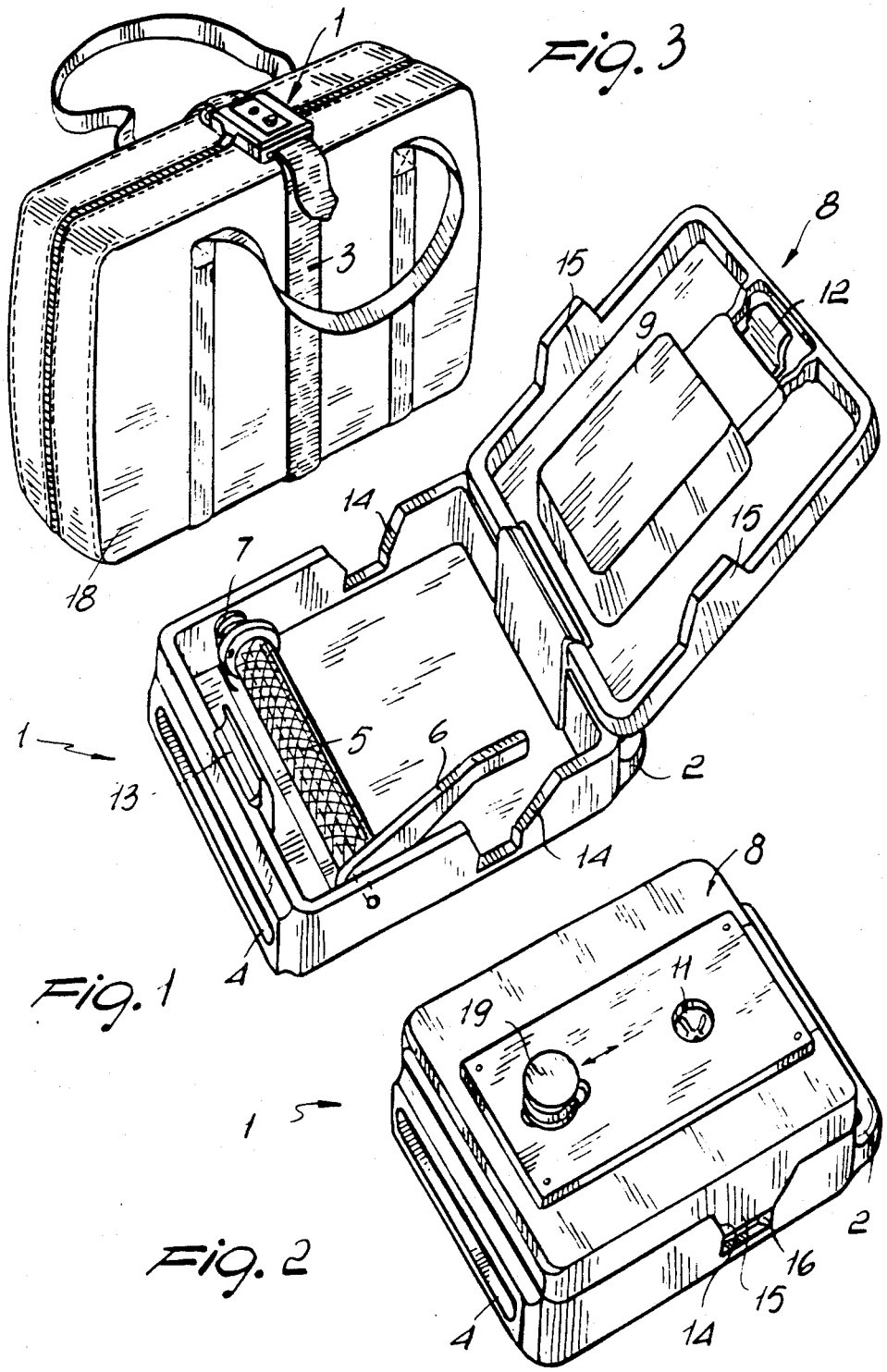
FIG. 1 is a perspective view of the strap lock according to the invention, with the box-type body open.
FIG. 2 is a perspective view of the strap lock according to the invention, with the box-type body covered by the lid.
FIG. 3 is a perspective view of the strap lock according to the invention, as mounted to a suitcase.

With reference to the drawings, a strap lock according to the invention comprises a box-type body, generally designated with the reference numeral 1, which has an outer bracket 2 for connection to a first end of a strap 3.

On the remote end from the bracket 2, the box-type body 1 has a slit 4 for the insertion of the second end of the strap 3 therethrough.

Inside the box-type body, there may be noticed a shaft 5 which extends along a substantially parallel axis to the slit 4 and can be turned about an eccentric axis, shown in dash lines in FIG. 1. The shaft 5, which forms the eccentric means of this invention, has one end associated rigidly with a lever 6 which extends along a substantially perpendicular axis to the axis of the shaft 5.

Figure 4:
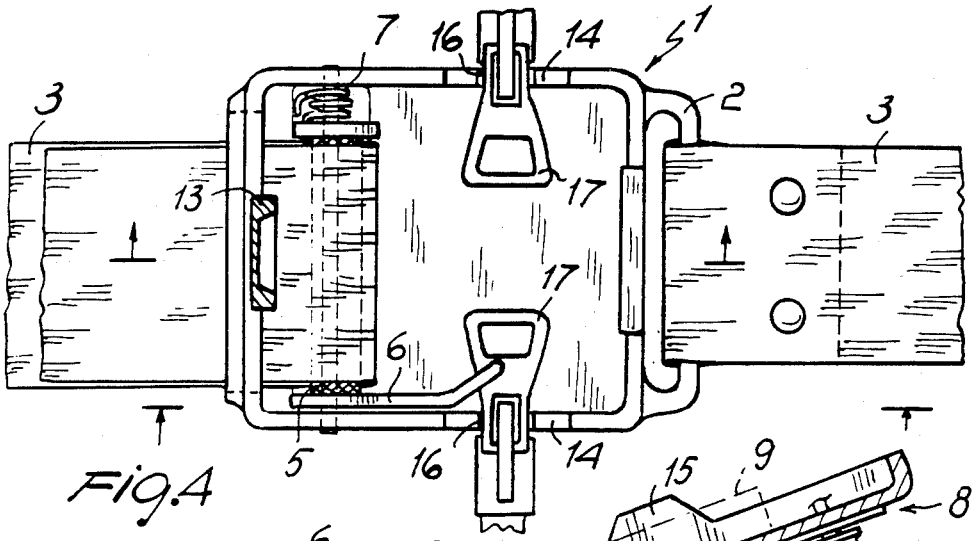
FIG. 4 is a top plan view of a strap lock according to the invention, in the act of being closed, with the lid removed.
Figure 5:
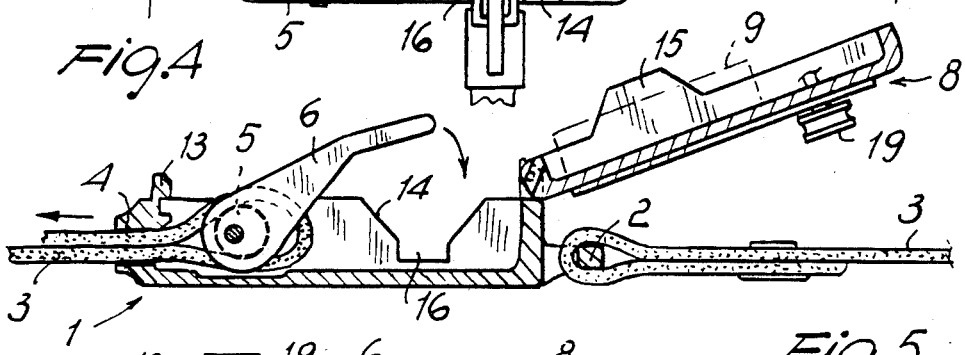
FIGS. 5 to 8 are sectional views of FIG. 4 showing the operation of the strap lock of this invention.
Figure 6:
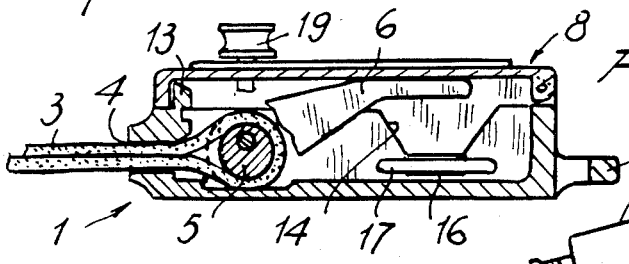
Figure 7:
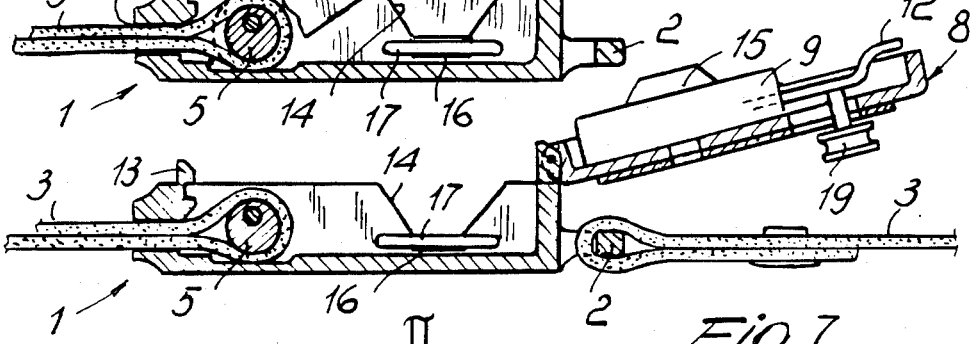
Figure 8:
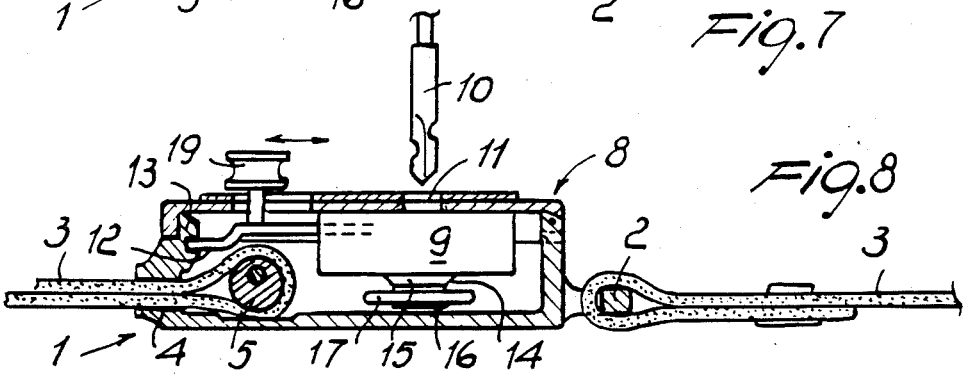

The remote end of the shaft 5 from the end associated with the lever 6 engages rigidly with one end of a spring such as a coil spring 7, which is coaxial with and has one end attached to the shaft 5, and has the other end attached to the inner surface of the box-type body 1 for biasing the shaft 5 towards a position whereat said lever protrudes outwardly from said box type body (see FIGS. 4 and 5). Advantageously, the shaft 5 may have its lateral surface knurled at intervals or throughout, to improve adhesion to the strap 3. The box-type body 1 has a wall, in this case the wall opposing the slit 4, hinged to a lid, generally indicated at 8, which can thus be swung about a substantially parallel axis to the axis of the shaft 5 to cover the box-type body 1.

On the inner surface or face, the lid 8 supports a safety lock 9 which is locked from the outside by means of a key 10 which is inserted through a specially provided opening 11.

The lock 9, of conventional design, acts to lock a tab 12 which during the locking interlocks with an expansion 13 carried correspondingly on the box-type body 1.

The tab 12 is rigid with conventional actuating pushbutton 19 which is carried on the outer surface of the lid 8 and allows the lid to be snap shut without operating the lock with the key.

Advantageously, the box-type body 1 has on opposing sides on the lateral surfaces a pair of bevel formations 14 which correspond with a pair of expansions 15, carried on the lid 8.

Thus, the surfaces of the box-type body and lid in mutual contact relationship define a pair of holes 16 whereinto the ends 17 can be inserted and locked of a commonly known closure under the trademarks of zipper, zip, etc., of the type commonly employed for the closure of bags, suitcases, and the like. The provision of the strap may prove unnecessary in this case.

The operation of the strap lock according to this invention will be apparent from the foregoing description.

The belt 3 is wrapped, for example, around a suitcase 18 and the second end of the strap 3 is inserted through the slit 4 such as to be passed between the shaft 5 and inner surface of the box-type body. Then, the end of the strap 3 is passed out through the slit 4 and the lid 8 is closed which, during this operation, acts through a portion of its inner surface on the lever 6 causing the shaft 5 to turn about the eccentric axis. Thus, the gap existing between the lateral surface of the shaft 5 and the inner surface of the box-type body 1 is reduced, and the strap 3 is, therefore, clamped or locked between the two surfaces without any allowance for further withdrawal of the same.

On completion of the closure one may act on the lock to lock the tab 12 and hence prevent the box from opening (and the strap from becoming disengaged without operating the key.

Where a suitcase is to be closed which has two zippers, it will be sufficient, prior to closing the lid, to insert the operating ends of the zipper into the bevels 14, as shown particularly in FIG. 4, the strap being unnecessary in this case.

To reopen and, accordingly, disengage the strap and possibly the operating end of the zipper, it will be sufficient to unlock the lock and act on the actuating pushbutton 14. On raising the lid, the lever 6 is turned upward and the spring 7 ensures rotation of the shaft 5 so as to quickly disengage the strap 3.

It has been found in practice that the strap lock according to the invention affords improved safety in the closures of bags, suitcases, or the like, it being adaptable to any types of luggage, even additionally to existing closures.

Another advantage of the strap lock according to the invention is that it may be used separately from the strap also for merely closing the operating ends of a zipper.

A not least advantage is that no strap is required which is perforated or slotted because locking occurs solely by pressure application and there occurs, therefore, no wear of any type.

In practicing the invention, the materials used and the dimensions may be any ones according to requirements and the state of the art.

I claim:

1. A strap lock for suitcases, bags or the like having in combination therewith a strap, said strap lock comprising a box-type body having an inner surface, at least one slit, a lid, eccentric means, connection means, and at least one lever, said strap having a first end portion and a second end portion, said connection means being adapted for rigidly associating said first end portion of said strap with said box-type body, said eccentric means being rotatably journalled to said box-type body above said inner surface thereof, said slit being formed in said box-type body for permitting said second end portion of said strap to be inserted into said box type body through said slit and passed between said inner surface and said eccentric means, said lever being rigidly associated with said eccentric means and adapted for moving said eccentric means towards said inner surface for selectively releasably clamping said second end portion of said strap between said eccentric means and said inner surface, said lid being adapted for closing said box-type body and for actuating said lever, said strap lock further comprising locking means, a tab, an expansion and an opening, said locking means being adapted for releasably locking said lid in a closed position, whereat said box-type body is closed and said lever is actuated for causing said eccentric means to move towards said inner surface, for clamping said second end portion of said strap between, said eccentric means and said inner surface, said expansion being rigidly internally associated with said box-type body, said locking means comprising a safety lock and key means, said lid defining an inner face adapted for being at least temporarily located opposite to said inner surface of said box-type body, said safety lock being rigidly associated with said inner face of said lid, said key means being adapted for co-operation with said safety lock, said opening being foromed in said lid and adapted for permittng said key means to be selectively, removably inserted into said safety lock, said tab being attached to said safety lock and adapted for engagement with said expansion for releasably locking said lid in said closed position.

2. A strap lock for suitcases, bags or the like having in combination therewith a strap, said strap lock comprising a box-type body having an inner surface, at least one slit, a lid, eccentric means, connection means, and at least one lever, said strap having a first end portion and a second end portion, said connection means being adapted for rigidly associating said first end portion of said strap with said box-type body, said eccentric means being rotatably journalled to said box-type body above said inner surface thereof, said slit being formed in said box-type body for permitting said second end portion of said strap to be inserted into said box type body through said slit and passed between said inner surface and said eccentric means, said lever being rigidly associated with said eccentric means and adapted for moving said eccentric means towards said inner surface for selectively releasably clamping said second end portion of said strap between said eccentric means and said inner surface, said lid being adapted for closing said box-type body and for actuating said lever, said strap lock further comprising locking means, said locking means being adapted for releasably locking said lid in a closed position, whereat said box-type body is closed and said lever is actuated for causing said eccentric means to move towards said inner surface, for clamping said second end portion of said strap between said eccentric means and said inner surface, said locking means comprising a safety lock, having an actuation key, an expansion, and pushbutton means, said expansion being rigidly associated with said box-type body, said safety lock being rigidly associated with said lid and adapted for locking engagement relationship with said tab, said actuation key being adapted for causing selective disengagement of said tab from said safety lock, said pushbutton means being adapted for permitting engagement of said tab by said safety lock in locking engagement relationship therewith, independently of said actuation key.

* * * * *